US005899151A

United States Patent [19]

Merkle, Jr., deceased et al.

[11] Patent Number: 5,899,151

[45] Date of Patent: May 4, 1999

[54] INDUSTRIAL FURNACE ROOF ASSEMBLY AND COMPONENTS THEREOF

[75] Inventors: Frank P. Merkle, Jr., deceased, late of Hanover; Howard R. Serlin, executor, Niles, both of Ill.

[73] Assignee: Merkle Engineers, Inc., Galena, Ill.

[21] Appl. No.: 08/874,273

[22] Filed: Jun. 13, 1997

[51] Int. Cl.[6] ..... F23M 5/06; F23M 5/02

[52] U.S. Cl. ..... 110/340; 110/331; 110/338; 110/339; 432/252

[58] Field of Search ..... 110/331, 338, 110/339, 340; 432/238, 252

[56] References Cited

U.S. PATENT DOCUMENTS 4,073,243 2/1978 Merkle, Jr. ..... 110/339

FOREIGN PATENT DOCUMENTS 615170 2/1961 Canada ..... 110/331
258347 9/1926 United Kingdom ..... 110/331

*Primary Examiner*—Ira S. Lazarus
*Assistant Examiner*—Ljiljana V. Ciric
*Attorney, Agent, or Firm*—Pauley Petersen Kinne & Fejer

[57] ABSTRACT

A high temperature industrial roof assembly having two refractory bricks with adjacent faces, opposing hanger recesses, a hanger rod extending from the recesses to the top of the assembly, the refractory bricks being held in an adjacent position by a securing device, a hanger rod with a locking mechanism at one end and a hook at the other end, a hanger having opposed refractory engaging projections adapted to engage the hanger recesses, a hanger rod hole allowing free rotation about the hanger rod end above the locking mechanism, and a locking mechanism engagement recess which when engaged with the locking mechanism prevents rotation of the hanger rod in relation to the hanger at 90 degree increments and provides that depression of the one end of the hanger rod into the locking mechanism engagement recess permits rotation of the hanger rod with respect to the hanger. The locking mechanism comprises opposing tabs. The hanger forms at least one slot adapted to permit the opposing tabs of the locking mechanism to pass through the hanger. The hanger forms engagement recesses adapted to receive the opposing tabs, the engagement recesses being offset laterally with respect to the at least one slot.

17 Claims, 4 Drawing Sheets

INDUSTRIAL FURNACE ROOF ASSEMBLY AND COMPONENTS THEREOF

BACKGROUND OF THE INVENTION

1. Field of the Invention

This invention relates to refractory assemblies and components thereof for use in industrial furnace roofs. More particularly, this invention relates to roof assemblies and components particularly suitable for repairing suspended refractory brick roofs.

2. Description of Prior Art

Refractory bricks are used in roof construction of high temperature industrial furnaces such as reverberatory furnaces. In furnace roof construction, the refractory bricks are suspended from a support structure which may be from several inches to about 2 feet above the brick roof. The refractory bricks are suspended from the support structure by various suspending means such as metallic hangers which hold the bricks at one end and hook over the support structure at the other end. Reverberatory furnaces are frequently operated for many years without shutdown. However, the life of the suspended roof which is usually constructed from refractories is from 6 months to 3 years. This makes patching of the roof furnace during operation necessary. Some roof refractory structures are panelized so that entire sections may be removed and replaced, or individual pairs of bricks in the panel may be patched by use of assemblies of this invention. In roofs which are not panelized, the roof is constructed by placement of individual or pairs of bricks. The assembly of this invention may be used, as well, in repair of non-panelized furnace roofs.

The refractory bricks used in high temperature furnace construction have a rectangular cross-section. Normally, in patching refractory roofs, two bricks are assembled with a hanger supporting both bricks in the patching assembly. The cross-section of the patching assembly is rectangular, normally occupying a space of 4½ by 7 inches. When patching the refractory roof, the opening for the patch assembly may have a long dimension which runs parallel to the longitudinal center line of the furnace or at right angles to it, depending upon the shape of the hole to be patched. The support structure, whether panelized construction is used or individual pairs of bricks are used, normally runs at right angles to the center line of the furnace.

Most patching or repair assemblies previously available, due to the opening being greater in one dimension than the other, require use of two types of assemblies. Since the plane of the hook of the hanger and the long dimension of the brick patching assembly were not rotatable with respect to each other, it has been necessary to provide one assembly with a hanger hook for attachment to the support structure parallel to the long dimension of the patch assembly and one with the hanger hook at right angles to the short dimension of the patch assembly. Therefore, it has been necessary to provide more than the required number of patch assemblies at the job site because it is not usually known until engaging in the repair which way the patch assembly will be introduced into the furnace. One approach to overcoming this disadvantage and utilizing patch assemblies having a hanger with a hook which may be used in both directions has been to provide a hanger with a mushroom-shaped head loosely fitting on the hanger casting recess, thereby allowing the hanger hook to rotate 360 degrees with respect to the bricks. This eliminates the inventory problem, but creates serious disadvantages in use because the refractory is free to rotate on the end of the hanger thereby making it difficult to insert the patch into the hole in the hot furnace roof, especially in cases where the patch must be inserted at an angle. Many of the same problems arise in new furnace construction.

These problems are solved by the industrial furnace roof assembly of our earlier U.S. patent, U.S. Pat. No. 4,073,243 which teaches an industrial furnace roof assembly in which brick pairs are suspended by an assembly of a hanger which mates with voids in both bricks, and a hanger rod which supports the hanger. The hanger has a square, upset-forged head which serves as the bearing surface for the hanger. The hanger rod passes through a hole in the hanger and is bent to form a hook which can be hung from a supporting member such as a pipe. In accordance with the '243 patent, the hanger rod is first passed through the hole in the hanger. The hanger, with the hanger rod engaged, is then seated into the void of one brick. A second brick is placed against the first brick such that the casing and hanger are at the split line of the two bricks. It is very common for an assembly of bricks, hanger and hanger rod to be encased in a steel casing and shipped as a complete assembly.

However, material handling of brick assemblies as taught by the '243 patent is complicated by the irregularity of the assembled brick pair with the hanger rod protruding out from the brick. Special care must be taken during packaging to assure that the bricks are properly supported without damage to the hanger rods. In addition, brick assemblies require more storage space.

SUMMARY OF THE INVENTION

Accordingly, it is one object of this invention to provide a brick assembly for repairing suspended refractory brick roofs of industrial furnaces in which material handling (packaging and storage) of hanging brick assemblies is simplified.

It is another object of this invention to provide a brick assembly for repairing suspended refractory brick roofs of industrial furnaces which provides the end user with the flexibility to install various hanger rods for different applications.

It is yet another object of this invention to provide a brick assembly for repairing suspended refractory brick roofs of industrial furnaces having the capability of installing the hanger rod after brick assembly.

It is another object of this invention to provide a single industrial furnace roof assembly which may be readily installed with its long dimension either parallel to or perpendicular to the center line of an operating industrial furnace suspended roof.

It is yet another object of this invention to provide a high temperature refractory roof assembly having a hanger which may be locked at 90° intervals in non-rotatable relationship with the hanger rod.

It is still another object of this invention to provide a high temperature refractory roof assembly having a hanger which may be rotated 90° with respect to the hanger rod.

These and other objects of this invention are achieved by a high temperature industrial roof assembly comprising two refractory bricks having adjacent faces, opposing hanger recesses, a locking means well beneath said recesses, and a hanger rod hole extending from the recesses to the exterior of the top of the assembly. The refractory bricks are held in an adjacent position by securement means. The assembly further comprises a hanger rod and means for inserting and removing said hanger rod from within said refractory bricks without removing said securement means. The hanger rod comprises locking means at one end and a hook at the opposite end. A hanger having opposed refractory engaging projections adapted to engage the hanger recesses is disposed within the two refractory bricks and forms a hanger rod hole allowing free rotation about the hanger rod end above the locking means. The hanger further comprises locking engagement means which when engaged with the locking means prevents rotation of the hanger rod in relation to the hanger in 90° increments and provides that depression of the one end of the hanger rod into the locking means well permits rotation of the hanger rod with respect to the hanger. The locking means comprises opposing tabs. Said means for inserting and removing said hanger rod from within said refractory bricks without removing said securement means comprises at least one slot formed by said hanger which is adapted to permit the opposing tabs to pass through the hanger. The hanger forms engagement recesses adapted to receive the opposing tabs, said engagement recesses being offset laterally with respect to the at least one slot.

BRIEF DESCRIPTION OF THE DRAWINGS

These and other objects and features of this invention will be better understood from the following detailed description taken in conjunction with the drawings wherein.

DESCRIPTION OF PREFERRED EMBODIMENTS

Figure 1:
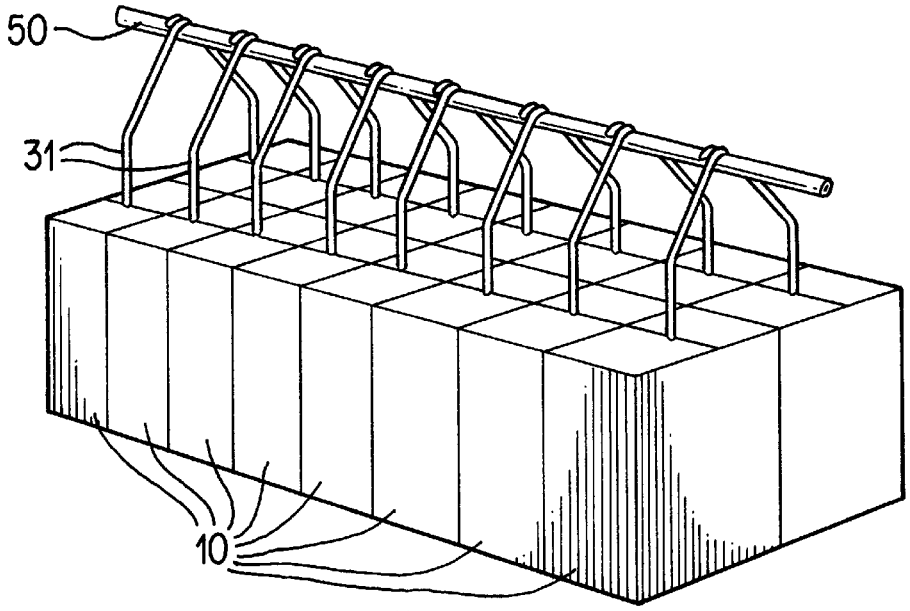
FIG. 1 PRIOR ART
FIG. 1 is a perspective view of a group of roof assemblies according to one embodiment of this invention suspended in a furnace roof.
Figure 2:
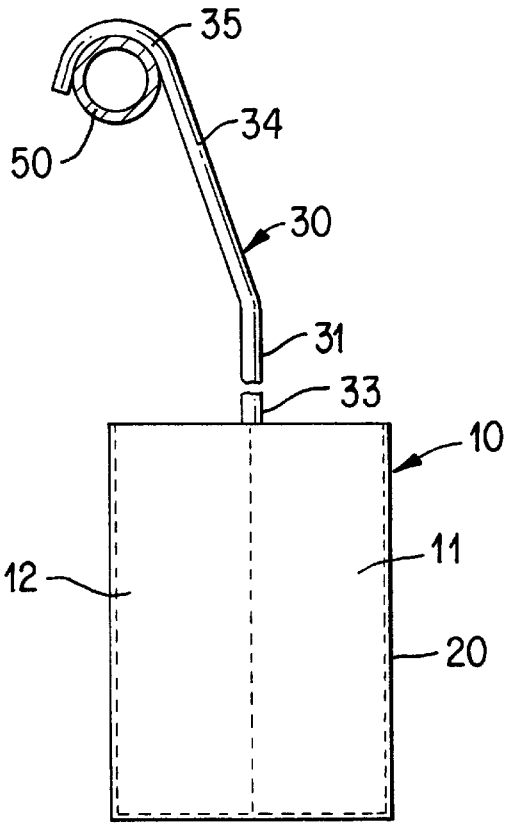
FIG. 2 PRIOR ART
FIG. 2 is a side view of one repair assembly of this invention.
Figure 3:
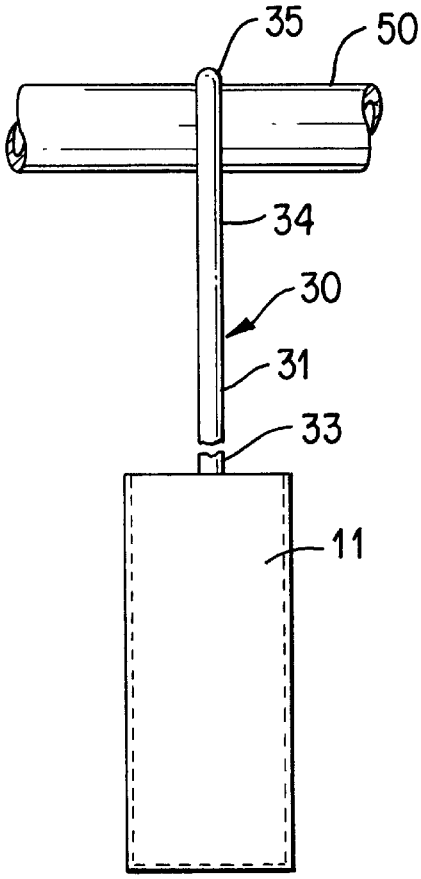
FIG. 3 PRIOR ART
FIG. 3 is an end view of the repair assembly shown in FIG. 2.

FIG. 1 shows sixteen adjacent roof assemblies 10 of this invention as they are suspended by hanger rods 31 from support structure 50 in an industrial furnace roof. FIGS. 2 and 3 show assembled roof assembly 10 comprising refractory bricks 11 and 12, hanger assembly 30 comprising hanger rod 31 and securement means for maintaining said refractory bricks 11, 12 in an adjacent position in the form of roof assembly casing 20. Suitable securement means include a cold rolled steel can encasing the sides and body of said assembly, metal strapping, wire, and/or fiberglass tape.

The refractory brick may be produced from any suitable material to provide the desired thermal and physical properties. Typical bricks suitable for purposes of this invention are basic refractories of magnesia and chrome ores, alumina-clay refractories, and silica refractories. The refractory brick may be made in any desired shape and size. Typically, the cross-section of the brick is 3½ by 4½ inches and the bricks are typically 9 to 15 inches deep.

Figure 4:
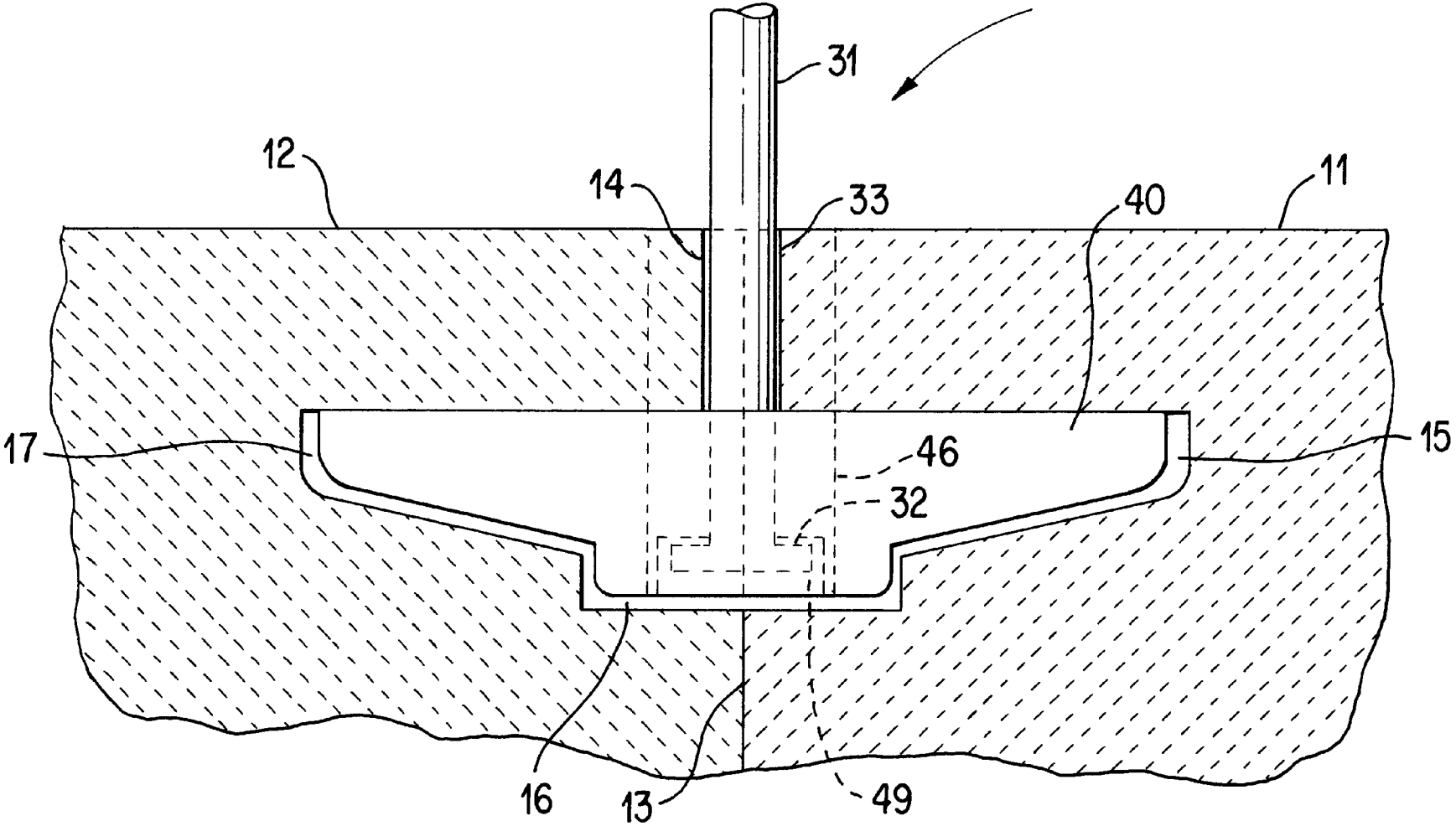
FIG. 4 is a partial sectional view as shown in FIG. 2 showing the hanger and hanger rod assembly in relation to a refractory brick.

As shown in FIG. 4, the refractory brick 11, 12 has adjacent face 13 for tight abutment to a matching adjacent face of a second refractory brick. Extending inwardly into refractory brick 11 from adjacent face 13 is a hanger recess 15 and beneath hanger recess 15 is locking means well 16. A corresponding hanger recess 17 is formed by the adjacent refractory brick 12. It will be apparent to those skilled in the art that locking means well 16 is optional depending upon the depth of hanger engagement recesses 49 formed by hanger 40. Hanger rod hole 14 extends from hanger recess 15 to the top of refractory bricks 11, 12. In the assembled position, two refractory bricks 11, 12 are held with their adjacent faces abutting by roof assembly casing 20. In the assembled position, the hanger recess 15 of one refractory brick 11 opposes the corresponding hanger recess 17 of the other refractory brick 12. The figures show a preferred embodiment wherein the locking means well 16, hanger rod hole 14, and hanger slot 46 for insertion of rod 31 through refractory bricks 11, 12 into hanger 40 are symmetrically disposed in each of the two refractory bricks 11, 12, each of the two refractory bricks 11, 12 having said generally opposing hanger recesses 15, 17 for support of the bricks. The roof assembly is more easily handled when the hanger rod 31 is over the center of gravity of the assembly.

Figure 8B:
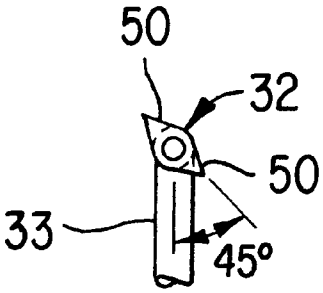
FIG. 8B is an end view of the insertion end of the hanger rod shown in FIG. 8A.
Figure 7:
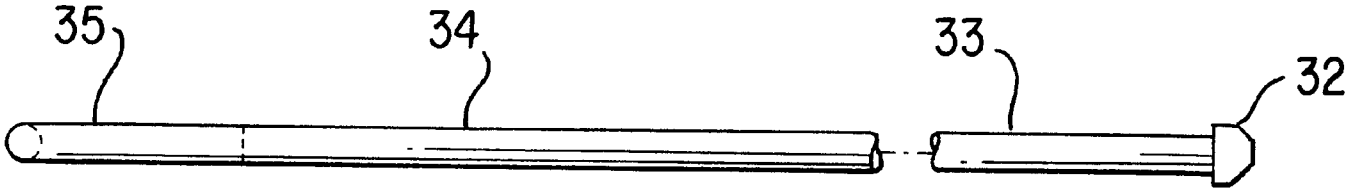
FIG. 7 is a front view of a hanger rod for a roof assembly in accordance with one embodiment this invention.
Figure 8A:
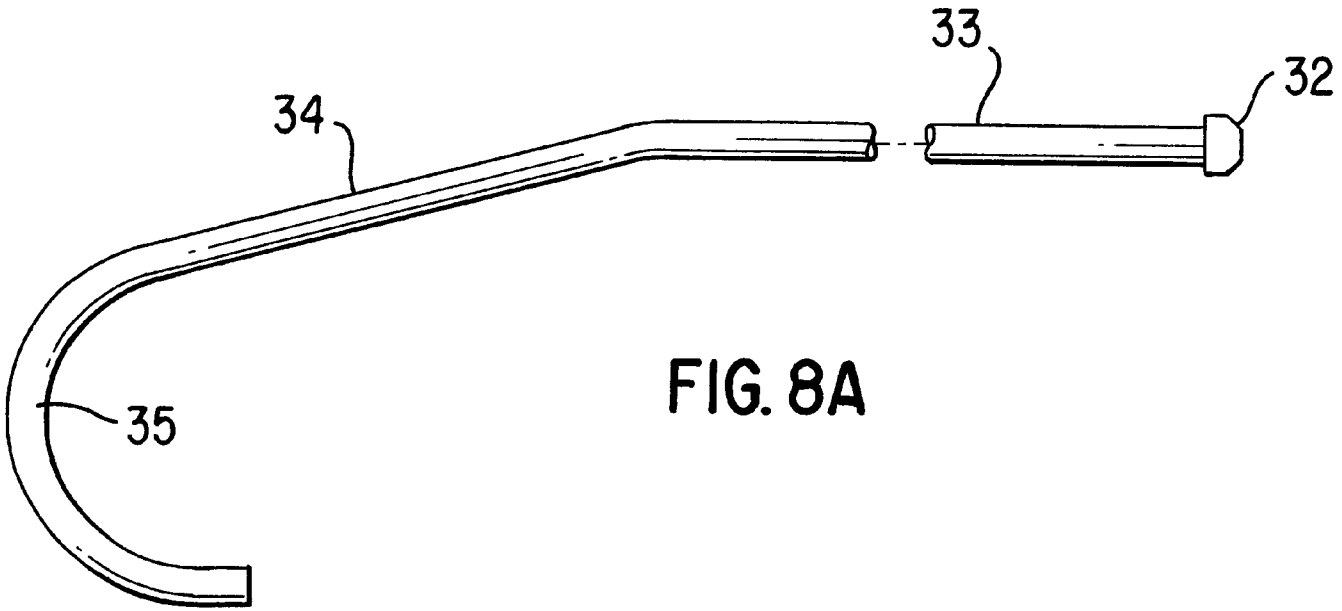
FIG. 8A is a side view of the hanger rod shown in FIG. 7.

Hanger assembly 30 comprises hanger rod 31 and hanger 40 (FIGS. 7, 8A and 8B). Hanger rod 31 comprises locking means 32 at one end and hook 35 at the opposite end. Hanger rod 31 is of suitable vertical height such that when hook 35 engages the furnace roof support means, the repair assembly is in the desired position in the furnace roof. Hanger rod 31 further comprises shaft portion 33 suitably sized to fit through hanger rod hole 14 and oblique shaft portion 34 terminating in hook 35. Oblique shaft portion 34 is of suitable length and angle to place hook 35 in the desired position with respect to the furnace roof support means. The supports of the furnace roof support means over which the hanger assembly 30 hooks usually are located above the junction of pairs of two refractory bricks 11, 12 to render insertion and removal of the bricks easier. This is one reason for the oblique shaft portion 34.

Figure 5:
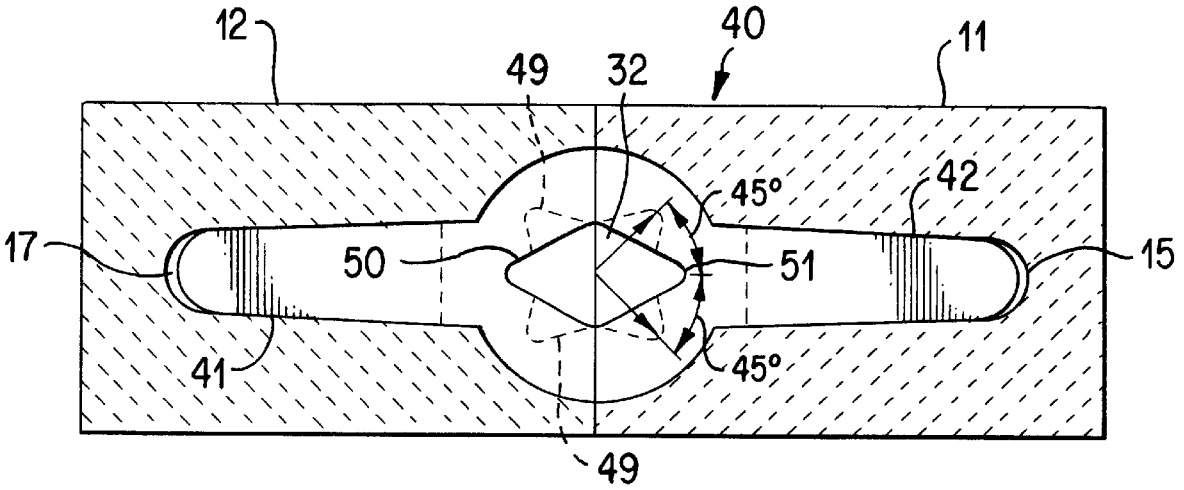
FIG. 5 is a bottom view of a hanger for a roof assembly in accordance with one embodiment of this invention.
Figure 6:
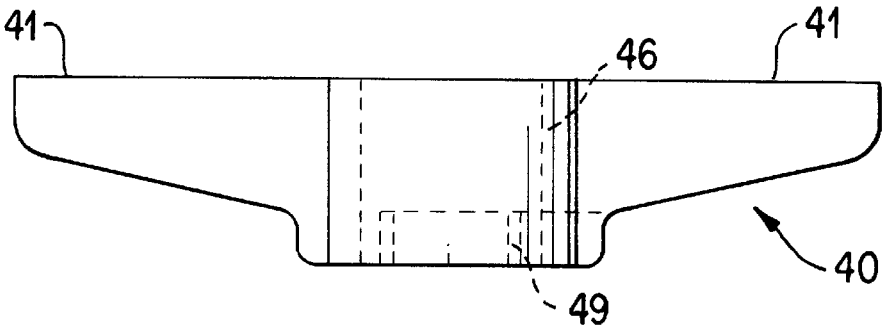
FIG. 6 is a side view of the hanger shown in FIG. 5.

Hanger 40 in accordance with one embodiment of this invention is shown in FIGS. 5 and 6. Hanger 40 comprises refractory engaging projections 41, 42 and forms hanger slot 46 for receiving upset-forged head 32 of hanger rod 31. Upset-forged head 32 comprises hanger engaging projections or tabs 50, 51 which are sized to fit into hanger slot 46 and engage hanger engagement recesses 49 formed by hanger 40 in a bottom surface thereof. Hanger rod 31, and thus upset-forged head 32, is rotatable within hanger rod hole 14, thereby enabling rotation of upset-forged head 32 so as to permit engagement of hanger engaging projections 50, 51 with hanger engaging projection recesses 49. Hanger engaging projection recesses 49 are offset by about 45 degrees with respect to hanger slot 46. In this way, hanger engaging projections 50, 51 are capable of engaging hanger engagement recesses 49 at at least 90 degree increments.

While in the foregoing specification this invention has been described in relation to certain preferred embodiments thereof, and many details have been set forth for purpose of illustration, it will be apparent to those skilled in the art that the invention is susceptible to additional embodiments and that certain of the details described herein can be varied considerably without departing from the basic principles of the invention.

We claim:

1. In a high temperature industrial furnace roof assembly comprising two refractory bricks having adjacent faces, opposing hanger recesses, a hanger rod hole extending from said recesses to the exterior of the top of said assembly, said refractory bricks held in an adjacent position by securement means, a hanger rod having locking means at one end and a hook at the other end, a hanger having opposed refractory engaging projections adapted to engage said hanger recesses, a hanger rod hole allowing free rotation about said hanger rod end above said locking means and locking engagement means which when engaged with said locking means prevents rotation of said hanger rod in relation to said hanger at 90° increments and provides that depression of said one end of said hanger rod into said locking means well permits rotation of said hanger rod with respect to said hanger, the improvement comprising:

insertion means for inserting said hanger rod into said refractory bricks while held in said adjacent position by said securement means;

said locking means comprising at least one pair of opposing tabs;

said hanger forming at least one hanger slot adapted to permit said opposing tabs to pass through said hanger; and said hanger forming engagement recesses adapted to receive said opposing tabs, said engagement recesses offset laterally with respect to said at least one slot.

2. A high temperature industrial furnace roof assembly in accordance with claim 1, wherein said insertion means comprises at least one refractory slot formed by said refractory bricks corresponding to said at least one hanger slot.

3. A high temperature industrial furnace roof assembly in accordance with claim 1, wherein said securement means is a cold rolled steel can encasing the sides and bottom of said assembly.

4. A high temperature industrial furnace roof assembly in accordance with claim 1, wherein said securement means are metal strapping.

5. A high temperature industrial furnace roof assembly in accordance with claim 1, wherein said securement means are wire.

6. A high temperature industrial furnace roof assembly in accordance with claim 1, wherein said securement means are fiberglass tape.

7. A high temperature industrial furnace roof assembly in accordance with claim 1, wherein said hanger rod extends obliquely to said hook from above said refractory brick.

8. A high temperature industrial furnace roof assembly in accordance with claim 1, wherein said two refractory bricks form a locking means well, said locking means well being beneath said opposing hanger recesses.

9. A hanger assembly for use in high temperature industrial furnace roofs comprising:

a hanger rod;

two refractory bricks having adjacent faces and forming opposing hanger recesses and a hanger rod hole extending from said recesses to the exterior of the top of said two refractory bricks;

securement means for holding said refractory bricks in an adjacent position;

insertion means for inserting said hanger rod into said refractory bricks while in said adjacent position;

a hanger having opposed refractory engagement projections adapted to engage said opposing hanger recesses securable to one end of said hanger rod, said hanger rod having a hook at an opposite end; and locking means for securing said hanger to said one end of said hanger rod whereby said hanger is completely separable from said hanger rod.

10. A high temperature industrial furnace roof assembly in accordance with claim 9, wherein said locking means comprises at least one pair of opposing tabs and said hanger forms at least one slot adapted to permit said opposing tabs to pass substantially vertically through said hanger.

11. A high temperature industrial furnace roof assembly in accordance with claim 9, wherein said hanger forms engagement recesses adapted to receive said opposing tabs, said engagement recesses offset laterally with respect to said at least one slot.

12. A high temperature industrial furnace roof assembly in accordance with claim 9, wherein said securement means is a cold rolled steel can encasing the sides and bottom of said assembly.

13. A high temperature industrial furnace roof assembly in accordance with claim 9, wherein said securement means are metal strapping.

14. A high temperature industrial furnace roof assembly in accordance with claim 9, wherein said securement means are wire.

15. A high temperature industrial furnace roof assembly in accordance with claim 9, wherein said securement means are fiberglass tape.

16. A high temperature industrial furnace roof assembly in accordance with claim 9, wherein said hanger rod extends obliquely to said hook from above said refractory brick.

17. A high temperature industrial furnace roof assembly in accordance with claim 9, wherein said two refractory bricks form a locking means well, said locking means well being beneath said opposing hanger recesses.

* * * * *